United States Patent [19]

Herbreteau

[11] 4,271,226

[45] Jun. 2, 1981

[54] INSULATING LAYERS FOR ELECTRICAL CABLES

[75] Inventor: Alain M. Herbreteau, Pau, France

[73] Assignee: Compagnie Francaise des Petroles, Paris, France

[21] Appl. No.: 857,841

[22] Filed: Dec. 5, 1977

[30] Foreign Application Priority Data

Dec. 3, 1976 [FR] France ..... 76 36451
Jan. 25, 1977 [FR] France ..... 77 02037

[51] Int. Cl.[3] ..... D03D 13/00; H01B 13/06

[52] U.S. Cl. ..... 428/220; 156/53; 156/86; 156/189; 174/110 PM; 174/110 SR; 174/DIG. 8; 428/222; 428/377

[58] Field of Search ..... 174/110 PM, 110 SR, 174/25 G, DIG. 8; 156/86, 53, 189; 428/913, 222

[56] References Cited

U.S. PATENT DOCUMENTS

| | | | |
|---|---|---|---|
| 3,144,499 | 8/1964 | Davey | 174/25 G |
| 3,229,024 | 1/1966 | Kang | 174/25 G |
| 3,450,968 | 6/1969 | Cox | 174/25 R |
| 3,758,353 | 9/1973 | Huriez | 156/53 |
| 3,767,838 | 10/1973 | McConnell | 174/25 G |
| 4,051,324 | 9/1977 | Anderson | 156/53 |

*Primary Examiner*—George F. Lesmes
*Assistant Examiner*—E. Rollins Buffalow
*Attorney, Agent, or Firm*—Sughrue, Rothwell, Mion, Zinn and Macpeak

[57] ABSTRACT

Electrical insulation for an elongate current carrying body, e.g. an underwater cable for carrying very high voltages, is provided by winding a tape round the body under tension, the tape being made of a film of an axially orientated polymer having a thickness less than 200 microns, and preferably between 10 and 50 microns, a significant degree of crystalline order, a high tensile strength, a high modulus of elasticity, and the ability to cling to itself.

4 Claims, No Drawings

INSULATING LAYERS FOR ELECTRICAL CABLES

The present invention relates to improvements in the insulation of elongate current carrying bodies, e.g. electric cables, particularly but not exclusively for very high voltage cables.

At present the electrical insulation of cable conductors is provided by one of two methods. According to one method an insulating synthetic polymer is extruded onto the conductor. However the process of extrusion of the polymer has the disadvantage of reducing the dielectric and viscoelastic properties of the polymer so that use of this type of insulation is restricted by the likelihood of premature dielectric breakdown of the insulation. Accordingly it is used for relatively low voltage cables only. According to the other method a tape is wound round the conductor, the tape being made of paper impregnated with a liquid dielectric and may be combined with a polymer tape. The tape is frequently wound on to the conductor in the presence of a dielectric oil or gas under pressure so that oil or gas is trapped in the windings of the tape to increase the insulating effect of the wound tape. The resulting insulated cable has then to be made impervious and this is presently effected by providing it with a lead sheath.

Because of the restrictions on the use of extruded polymer as insulation, submarine cables are presently insulated using tape as described above, the tape being wound onto the conductor in an atmosphere of oil or gas under pressure. However because of the trapped oil or gas, there are significant constraints on the depth to which such a cable can be submerged and the length of such a cable. Generally such a cable is suitable for depths less than 500 meters and the quality of insulation is such that the voltage must not exceed 250 to 300 kV, the maximum load capacity of the cable being 300 MW.

According to one aspect of the present invention there is provided an electrically insulating material for insulating elongate current carrying bodies, the material comprising a tape made of a film of an axially orientated polymer having a thickness less than 200 microns, a significant degree of crystalline order, high tensile strength, a high modulus of elasticity, and the ability to cling to itself.

According to another aspect of the present invention there is provided an electrically conductive component, e.g. a cable, comprising an elongate current carrying body and electrical insulation surrounding the body provided by at least one tape wound round the body with successive layers overlapping, the/or each tape being as described above.

According to yet another aspect of the present invention there is provided a method of insulating a current carrying body comprising winding at least one tape under tension around the body so as to overlap successive layers of the tape, the/or each tape being as described above.

To enhance the clinging properties of the tape, the film from which it is made preferably has a constant thickness and a uniform surface condition. Preferably the film has the thickness of between 10 and 50 microns and advantageously between 10 and 25 microns.

Because of the high tensile strength and elasticity of the tape, the tape can be compactly wound onto the body so that the resulting layer of insulation is cohesive. Additionally the layers of tape do not slide relative to one another when the body is longitudinally deformed, e.g. when the body is a cable and the cable is wound onto a drum.

Advantageously the tape is biaxially orientated and is capable of shrinking when heated. If it is required to increase the compaction of the insulating layer the tape can be heated during or after application to the current carrying body so as to shrink it onto the body, thereby increasing the compaction of the layer. The temperature to which the tape is heated is below the softening point of the material of the tape, and preferably between 5 and 40 C.° below the softening point.

Where the film from which the tape is made is biaxially orientated, it is preferably made conventionally by a process including flat axial stretching of the film, the film preferably being axially stretched at a temperature between 50° C. and 160° C. and the ratio of the unstretched length of the film to the stretched length being between 3 and 7.

During the tape winding operation air, a dielectric gas is unavoidably trapped in the very small spiral spaces which exist at the lateral edges of each tape layer. These spaces are restricted in the radial direction of the insulating layer to the thickness of the tape. The inclusion of a dielectric gas within the insulating layer is unavoidable but it is not necessary to the dielectric properties of the insulation provided by the tape. However the insulating properties of the tape layer can be further enhanced by the deliberate introduction of a dielectric gas at the lateral edges of each layer of tape during or subsequent to the tape winding operation. Such a gas may be any one or a mixture of the following:

Air, $N_2$, $SF_6$, $CCl_3F$, $CCl_2F_2$, $CH_3I$, $CCl_4$, $CHCl_3$, $CH_3COCl$, $CS_2$, $CCl_2COCl$, $CHCl_2F$, $CHClCCl_2$, $CH_2Cl_2$, $CH_2ClCHCl_2$, $CH_3Cl$, $CH_3CHO$, $CH_2ClF$, CO, $CHCl_2CHCl_2$, $CH_3Br$, $CH_4$, $CH_2ClCH_2Cl$, $CH_3NO_2$, $CH_2ClCH_2OH$, $C_2F_6$, $CH_3COSH$, $CH_3—CH_2—C(CH_3)=CHCH_2OH$, $C_2Cl_3F_3$, $BCl_3$.

$SO_2$, $PCl_3$, $SOCl_2$, $SO_2Cl_2$, $Cl_2$, $C_2H_5ONO_2$, $SH_2$, $C_4F_8$, $C_3F_8$, $C_2H_4$, $TiCl_4$, $HCOOCH_3$, $N_2O$, $POCl_3$, $C_2H_2$, $C_2H_5NH_2$, $(CH_3)_2NH$, $S_2Cl_2$, $C_6H_5NO_2$, $(C_2H_5)_2O$, $C_2H_5OH$, $CF_4$, $C_2H_5Cl$, $C_6H_5COCl$, $(CH_3)_2C=CH_2$, $H_2$, $CO_2$, $O_2$, $CHClF_2$, $C_2ClF_5$, $C_2Cl_2F_4$.

The tape may be made of a suitable homopolymer, copolymer or terpolymer.

The film may be made from a stereoregular homopolymer of isotactic character and of the general formula $(—CH_2—CHR)_n$. By way of example R may be any one of the following

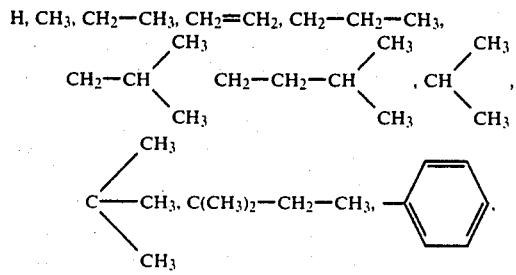

-continued

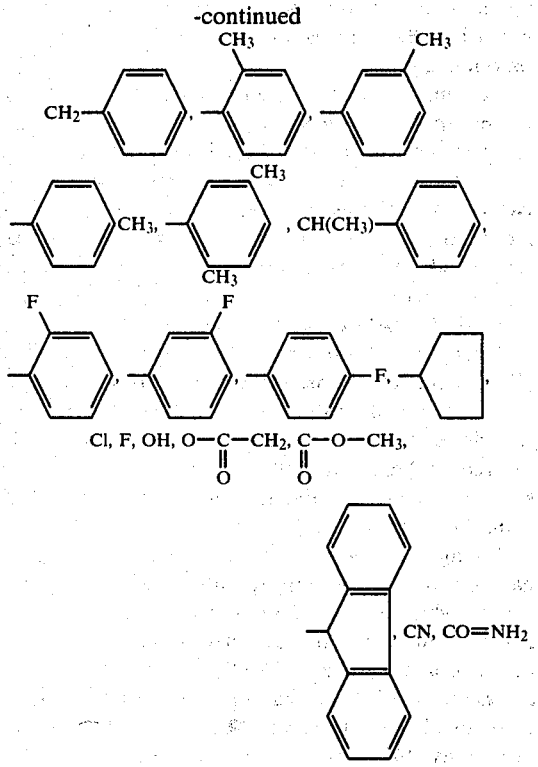

Examples of other homopolymers which may be used for the film are:

Poly-(4,4'-diphenylenepropane carbonate) in the group of the polycarbonates poly-(ethylene terephthalate) in the group of the polyesters poly-(hexamethylene adipamide) in the group of the polyamides poly-(oxyphenylene) in the group of the poly-(arylene oxides)

polysulphones polyvinylidene halides polyvinyl halides poly-(methylmethacrylate)

poly-(tetrafluorethylene)

poly-(monochlorotrifluoroethylene)

poly-(vinylene chloride)

6, 6.6, 6.10, 10 and 11 polyamides

Preferred copolymers and terpolymers for the film are synthesized from the above homopolymers. An example of a terpolymer which may be used for the film is fluorinated ethylene-propylene terpolymer.

All the foregoing polymers have a weight-average molecular weight between 200,000 and 700,000 and preferably between 350,000 and 500,000. The percentage crystallinity is between 40% and 90% and preferably between 50% and 80%.

The significant weight-average molecular weight of the polymers and the consequent strong cohesion of the molecules and absence of substantial voids means that the polymers can be made into films and the films stretched without tearing, and that the films can be classified as "impermeable" films, that is to say flawless films.

The significant degree of crystalline order of these polymers means that films made from them will have a high tensile strength, elasticity and dielectrical rigidity.

In a preferred embodiment the tape is made from a biaxially orientated film of isotatic polypropylene which is characterised by the following:

Thickness = 25 microns

Weight-average molecular weight = 430,000

Longitudinal tensile strength = 14 daN/mm$^2$

Transverse tensile strength = 25 daN/mm$^2$

Crystallinity = greater than 50%

This film possesses a high dielectric strength for direct current which is greater than 630 kV/mm and possesses a low dielectric constant of 2.2 and a low loss factor of the order of $2\times10^{-4}$.

The film tape is wound onto the body to be insulated under a tension which is within the limits of elasticity of the tape. For example a tape made from a film having a thickness of 25 microns and a width of 20 mm may be wound under a tension of 500 gms. Preferably, the tension should not be less than 0.4 daN per square unit millimeter. The degree of overlap between successive layers of the tape is varied in dependence on the level of insulation required, i.e. on the maximum voltage and current to be carried by the body.

If it is required to further compact the layers of tape, in addition to winding the tape onto the body under tension, the tape may be heated during or after application to the body so as to shrink it. In the case of a tape of isotatic polypropylene, the tape is heated to a temperature of between about 100° C. and 135° C., which is below the softening point of the polypropylene. This heating of the polypropylene film has the additional advantage of increasing the crystalline order of the material.

By way of example only, a submarine cable for very high voltage using direct current comprises:

a conducting core of an electrically conductive metal such as aluminum or an aluminium alloy, aluminium with a steel support, or copper;

an anhydrous semi-conducting layer of polyethylene or an extruded ethylenepolypropylene copolymer or other material;

an electrically insulating layer of tape as described above, the tape being made of an isotactic polypropylene film;

a semi-conducting layer similar to that covering the core;

screening; and anti-corrosive protection.

There is thus provided an electrical insulation and a method of electrically insulating by which a synthetic insulating layer is provided for an electric cable conductor, the layer being made of a polymer in the form of a film so that it retains the dielectric and visco-elastic characteristics of the basic polymer. The insulating layer is composed of a plurality of superimposed tape layers which provide a plurality of polymer-polymer interfaces which inhibit the development of currents. These electrical characteristics are coupled with the mechanical characteristics of the tape itself and those resulting from the compact and therefore coherent nature of the insulating layer which can be obtained because of the elasticity of the film tape. The insulating layer does not need to depend on the inclusion of a dielectric gas or oil to provide sufficient insulation and has greater reliability than that of either an extruded synthetic insulation or a conventional tape wrapped insulation. The thickness of the insulating layer can be varied to vary the degree of insulation provided and is varied in dependence on the nominal operating voltage of the current carrying body. The insulation provided by the above described insulation layer can be sufficient for very high electrical voltages and load capacities, e.g. 500 MW to 1,000 MW at a potential gradient in the conductor of 80 kV/mm. Because of the excellent mechanical characteristics of the insulating layer, a cable provided with such an insulating layer can be immersed at depths in excess of 500 meters.

While the invention has basically been described in connection with the insulation of electrically conductive cables for use under water and for carrying high voltages, the insulation may equally be used for insulating lower voltage carrying cables, ground cables, telephone cables etc., and for both a.c. and d.c. cables.

What is claimed is:

1. An electrical conductor having thereon a synthetic non-impregnated insulating structure consisting essentially of a tape comprising a biaxially oriented film of a thickness of less than 200 microns, a tensile resistance of higher than 5 DAN/mm$^2$, and comprising an isotactic stereo-regular olefin polymer of a weight average molecular weight of between 200,000 and 700,000, and a crystallinity between 40% and 90%, said tape having been subjected to a flat biaxial orientation at a stretching ratio between 3 and 7, said tape when wound on an electrical conductor under a tension not less than 0.4 DAN/mm$^2$ clinging to itself and providing an insulating structure of a coherent, self-cohesive nature, said insulating structure being in the form of a plurality of layers of said tape on top of each other in intimate non-sliding contact with each other, each of said layers being a length of said tape wound so as to at least partially overlap an underlying wrap of said length of tape, each of said layers comprising a plurality of said at least partially overlapping wraps.

2. The electrical conductor of claim 1, wherein the film is made of biaxially oriented isotactic polypropylene homopolymer.

3. The electrical conductor of claim 1, wherein the film has a thickness of between 10 and 50 microns.

4. The electrical conductor of claim 1, wherein the olefin polymer is a stereo-regular isotactic homopolymer of the formula $(-CH_2CHR)_n$ in which R is selected from the group consisting of

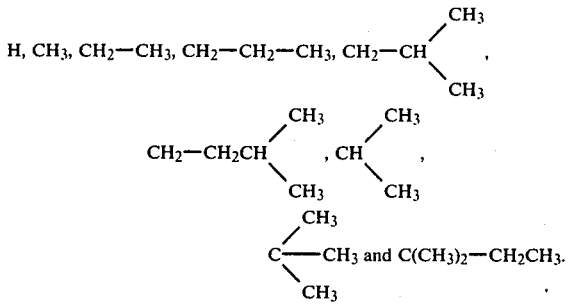

* * * * *